US006948638B2

(12) United States Patent
Tu

(10) Patent No.: US 6,948,638 B2
(45) Date of Patent: Sep. 27, 2005

(54) LIQUID RATIONING DEVICE

(75) Inventor: Ming Te Tu, Ping Chen (TW)

(73) Assignees: Kuei-Tang Chou, Taoyuan Hsien (TW); Ming-Te Tu, Taipei Hsien (TW)

( * ) Notice: Subject to any disclaimer, the term of this patent is extended or adjusted under 35 U.S.C. 154(b) by 0 days.

(21) Appl. No.: 10/735,787

(22) Filed: Dec. 16, 2003

(65) Prior Publication Data

US 2005/0127104 A1 Jun. 16, 2005

(51) Int. Cl.[7] ..... B65D 37/00

(52) U.S. Cl. ..... 222/209; 222/214; 222/102; 222/333; 417/474; 417/476; 417/477.3; 417/477.6

(58) Field of Search ..... 222/209, 207, 222/214, 215, 181.1, 185.1, 101–102, 504, 222/333; 417/474–478, 477.1, 477.3, 477.6, 417/477.12, 477.9

(56) References Cited

U.S. PATENT DOCUMENTS

| | | | | |
|---|---|---|---|---|
| 1,765,360 | A * | 6/1930 | Baumann | 417/477.12 |
| 3,384,080 | A * | 5/1968 | Muller | 604/153 |
| 3,565,554 | A * | 2/1971 | Muller | 417/477.12 |
| 3,591,319 | A * | 7/1971 | Shlisky | 417/477.12 |
| 4,273,260 | A * | 6/1981 | Bush | 222/135 |
| 4,274,409 | A * | 6/1981 | Bush | 604/153 |
| 4,559,040 | A * | 12/1985 | Horres et al. | 604/153 |
| 4,667,854 | A * | 5/1987 | McDermott et al. | 222/101 |
| 4,705,464 | A * | 11/1987 | Arimond | 417/477.7 |
| 4,925,376 | A * | 5/1990 | Kahler | 417/477.11 |
| 4,946,070 | A * | 8/1990 | Albert et al. | 222/52 |
| 5,037,274 | A * | 8/1991 | Holmes et al. | 417/53 |
| 5,269,443 | A * | 12/1993 | Lancaster | 222/207 |
| 5,718,568 | A * | 2/1998 | Neftel et al. | 417/476 |
| 6,626,867 | B1 * | 9/2003 | Christenson et al. | 604/153 |

FOREIGN PATENT DOCUMENTS

| | | | | |
|---|---|---|---|---|
| EP | 493865 | A1 * | 7/1992 | A47K 5/12 |

* cited by examiner

*Primary Examiner*—Frederick Nicolas
(74) *Attorney, Agent, or Firm*—Leong C. Lei

(57) ABSTRACT

A liquid rationing device comprises a base and a cover. The base is provided with an actuating element whose axle goes through the base. The axle is connected with a gear disk, which is provided with more than one roller on one side thereof. The cover is coupled to one side of the base and has a reservoir provided with a transmission hose with positioning extrusion. A positioning groove is provided on the reservoir such that the positioning extrusion of the transmission hose can be held therein and the transmission hose can surround the circle of the rollers. Accordingly, the actuating element can drive the gear disk and make the rollers on the gear disk to rotate and subsequently push and squeeze the transmission hose, thereby making displacement of the liquid in the transmission hose and obtaining the purposes of rationing.

8 Claims, 4 Drawing Sheets

LIQUID RATIONING DEVICE

BACKGROUND OF THE INVENTION (a) Technical Field of the Invention

The present invention relates to a liquid rationing device, particularly to a device allowing the liquid in a transmission hose be pushed and squeezed by rollers to obtain the purposes of rationing.

(b) Description of the Prior Art

As disclosed in R.O.C. Patent No. 314762 entitled "Improved Structure of Soap Dispenser", the structure is composed of a base, a cover, at least one set of liquid soap containers and the dispensing buttons provided adjacent to the outlet of the liquid soap containers. Wherein the dispensing button, including a piston tube provided with a plug bar, button and tube outlet, etc., is characterized in that:

the clips provided at the upper and lower portion of the inner base are formed by two opposite arc flakes, which can correspondingly clamp the neck of the liquid soap containers; the lower clip includes clip posts formed oppositely at the rims of a hole cavity for correspondingly clamp the piston tube of the dispensing button; a pivotal connector being provided with a hole and a slanting wall at two sides is formed at the top of the base;

a connecting post which is opposite to the connection portion of the cover and respectively provided with a locking flake is formed at the corresponding inner walls of the top cover; and two corresponding positioning flakes are formed at the outside walls of the piston tube of the dispensing button; while a positioning bar, going through and in-between the two positioning flakes, is formed at the position corresponding to the inner rim of the button.

Although the above-mentioned "Improved Structure of Soap Dispenser" can allow a user to push the dispensing button and drive the bars and button, thereby dispensing the liquid soap from the inside of the container through the tube outlet, the user must apply a certain force manually for this operation. When the user happens to be a kid without sufficient force to do this operation, he/she would be unable to get the liquid soap. In addition, when the user pushes the dispensing button with his/her wet hand, it will always get a slip and make the force hardly applied on the button. Accordingly, there exists a need to further improve the prior arts of the kind.

SUMMARY OF THE INVENTION

The primary object of the invention is to provide a liquid rationing device for use in soap dispensers, which may obtain the purpose for the liquid in a transmission hose by way of the push and squeeze of the rollers.

The secondary object of the invention is provide a liquid rationing device for use in soap dispensers, which is provided with a gear and a gear disk connected therewith, such that the gear disk can drive the rollers to rotate planetarily, thereby pushing and squeezing the transmission hose and being adapted to transmit thicker liquid.

To obtain the above purpose, the invention discloses a liquid rationing device, which includes a base and a cover. The base is provided with an actuating element whose axle goes through the base. The axle is connected with a gear disk, which is provided with more than one roller on one side thereof. The cover is coupled to one side of the base and has a reservoir provided with a transmission hose with positioning extrusion. A positioning groove is provided on the reservoir such that the positioning extrusion of the transmission hose can be held therein and the transmission hose can surround the circle of the rollers. Accordingly, the actuating element can drive the gear disk and make the rollers on the gear disk to rotate and subsequently push and squeeze the transmission hose, thereby making displacement of the liquid in the transmission hose and obtaining the purposes of rationing.

To completely appreciate these and other objects of the present invention as well as the invention itself, all of which will become apparent to those skilled in the art the following detailed description of the invention and the claims should be read in conjunction with the accompanying drawings.

DETAILED DESCRIPTION OF THE PREFERRED EMBODIMENT

Figure 1:
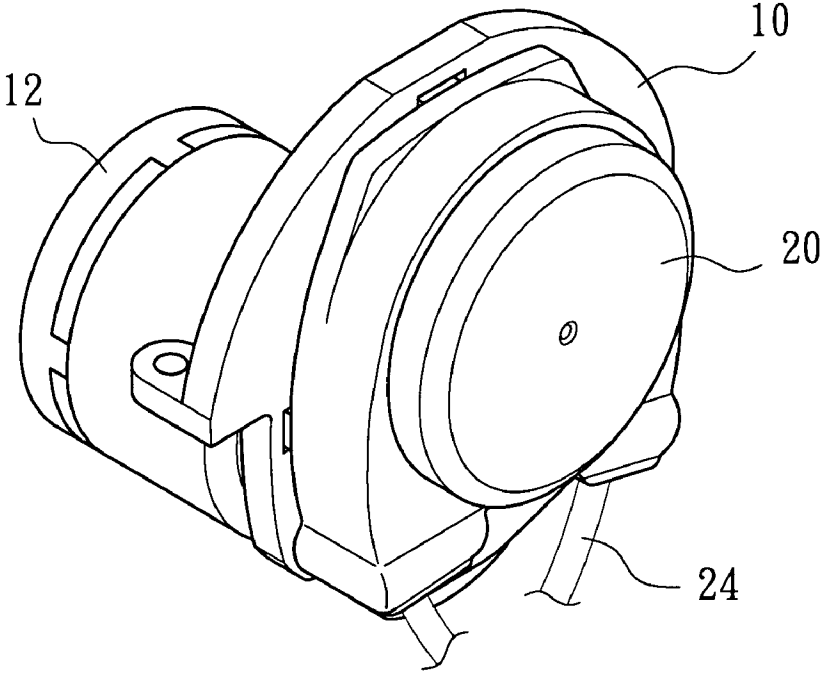
FIG. 1 is a perspective view of the present invention.
Figure 2:
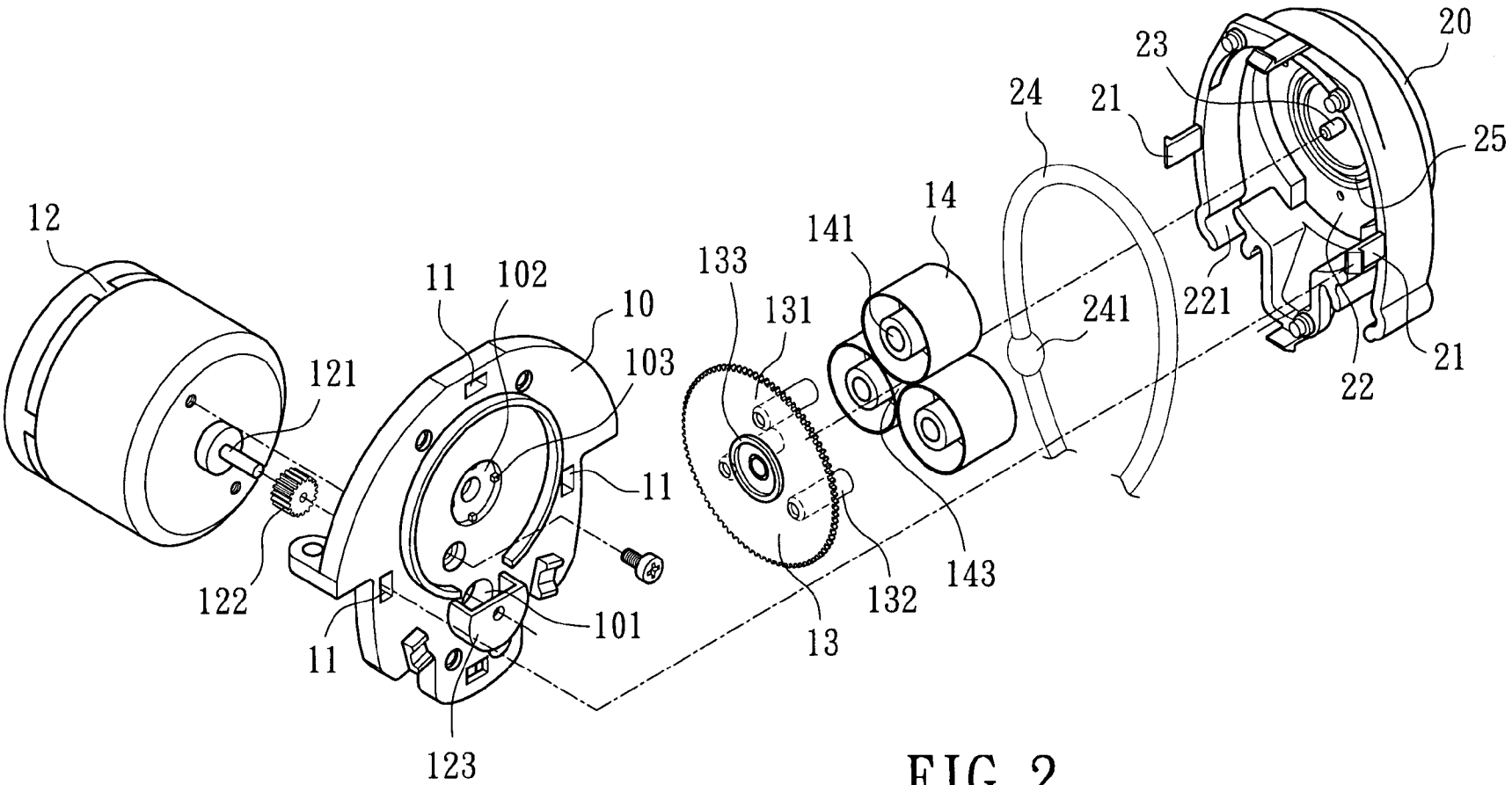
FIG. 2 is an exploded view of the present invention.

Referring to FIGS. 1 and 2, the invention relates to a liquid rationing device, which comprises a base 10 and a cover 20.

The base 10 is provided with more than one locking holes 11 at the pre-determined positions on the circle thereof, while an actuating element 12 is provided on the bottom of the base 10 and the axle 121 thereof goes through a hole 101 on the base 10. The actuating element 12 can be a motor. The axle 121 is connected with a gear disk 13, which provided by teeth 131. A gear 122 is provided in-between the axle 121 and the gear disk 13 such that the gear 122 can be engaged with the teeth 131 of the gear disk 13, and drive the gear disk 13 to rotate. Besides, more than one roller 14 are provided on one side of the gear disk 13, while more than one positioning post 132 are provided on the same side for engaging the holes 141 of the rollers 14 for the purposes of positioning. A protruding ring 133 is provided at the central bottom of the gear disk 13 to mount on a hollow portion 102 on the center of the base 10 for the purpose of central positioning, while extrusions 103 arc provided in the hollow portion 102 for reducing friction. In the embodiment, the gear base 10 is provided with a shield 123 which has an outer diameter greater than that of the gear 122, such that when the gear 122 goes in the hole 101 of the base 10, it can be kept by the shield 123 without detachment (as shown in FIG. 4).

The gear disk 13 is provided with more than one roller 14 at one side, which can be alternatively formed integrally with the gear disk 13 without the need of the positioning posts 132 on the gear disk 13.

Figure 3:
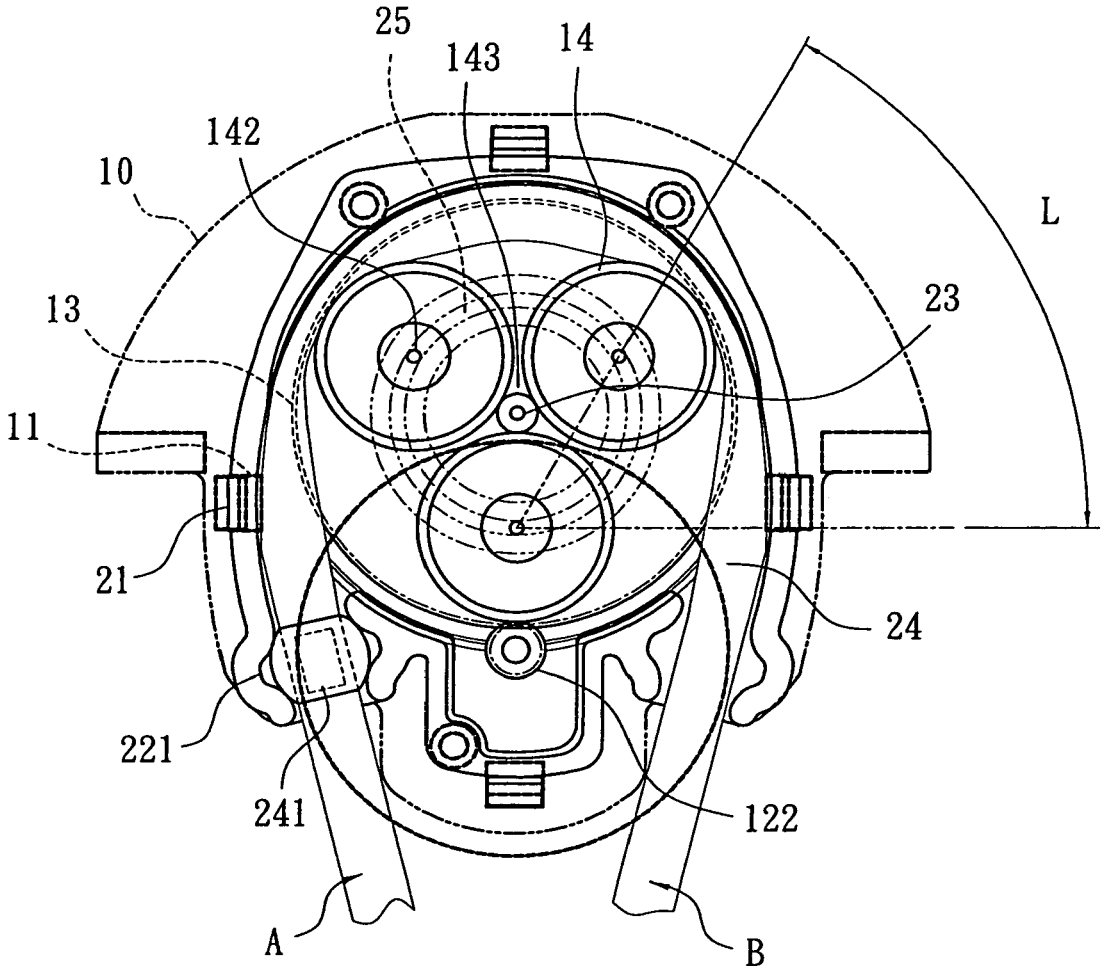
FIG. 3 is a front view of the invention after being assembled.
Figure 4:
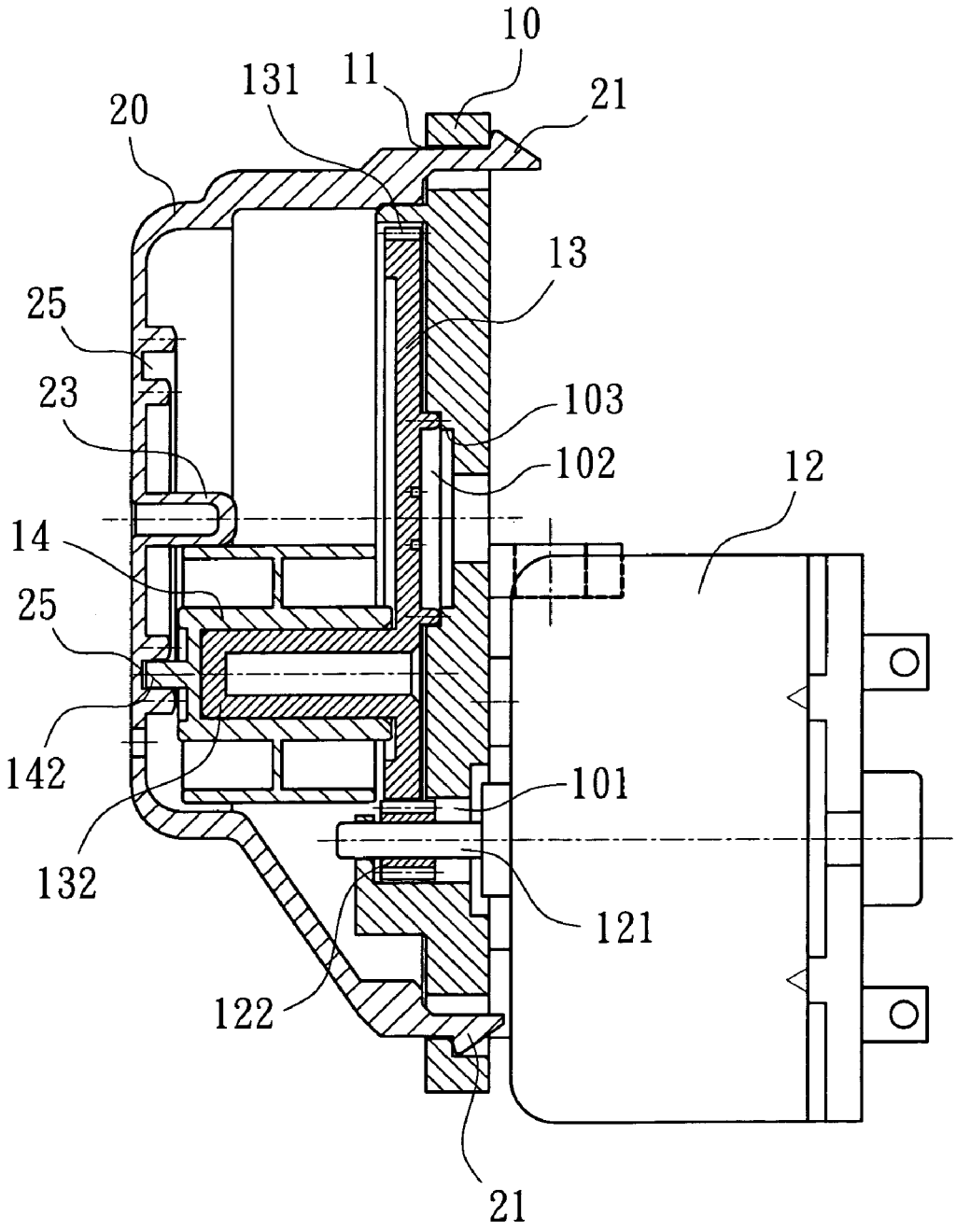
FIG. 4 is a cut-away view of the invention after being assembled.

Furthermore, in a preferred embodiment of the invention, a positioning extrusion 142 (as shown in FIGS. 3 and 4) is protrusively provided on a side of the roller opposite to where the central hole is provided, so that when the position extrusions 142 are combined with the base 10, they can be engaged in the circle groove 25 of the cover 20.

The cover 20 is provided more than one locking flap 21 at the pre-determined positions on the circle thereof for locking with the locking holes 11 at the circle of the base 10, thereby permitting the cover 20 to couple to one side of the base 10. The cover 20 has a hollow reservoir 22, at the center of which is provided with a pivot 23 for inserting to a center hole of the gear disk 13 for the purposes of positioning. A transmission hose 24 with a positioning extrusion 241 is provided around the hollow reservoir 22. The positioning extrusion 241 is in hollow form and has a diameter greater than that of the transmission hose 24. Besides, a positioning groove 221 is provided on the reservoir 22 such that the positioning extrusion 241 of the transmission hose 24 can be held therein and that the transmission hose 24 can surround the circle of the rollers 14 (as shown in FIG. 3) and be positioned in the central portion 143 formed by the three rollers 13.

Accordingly, the actuating element 12 can drive the gear disk 13 to rotate and make the rollers 14 on the gear disk 13 to rotate and subsequently push and squeeze the transmission hose 24, the two sides of the transmission hose 24 are pushed and squeezed by the inner wall of the base 10 and the rollers 14, thereby making displacement of the liquid in the transmission hose 24 and obtaining the purposes of rationing.

As shown in FIGS. 3 and 4, when the invention is in a use status, the actuating element 12 is connected to a power and switch (not shown), as well as a control circuit (not shown), if necessary, for controlling the operation of the actuating element 12. One end of the transmission hose 24 is connected to the interior of the liquid reservoir (not shown), such that the liquid in the reservoir can be drawn by the transmission hose 24.

When a user switches on the actuating element 12 to rotate, the axle 121 of the actuating element 12 will rotate and subsequently drive the gear 122 mounted on the axle 121 to rotate as well. When the teeth 131 drive the gear disk 13 and make the rollers 14 at one side of the gear disk 13 to rotate, the plurality of rollers 14 will respectively push and squeeze the transmission hose 24 around the circle of the reservoir 22. By way of the push and squeeze power generated between the rollers 14 and the inner walls of the reservoir 22, the liquid in the transmission hose 24 can be pushed and squeezed from the inlet end A to the outlet end B (as shown in FIG. 3). As the liquid in the transmission hose 24 is transmitted by way of the push of the rollers 14, the rotation displacement between each two rollers 14 can form a compression section L on the transmission hose 24, thereby transmitting certain liquid in the compression section L and presenting a rationing condition. In the embodiments of the invention, each of the three rollers 14 is pivotally mounted on each positioning post 132 of the gear disk 13, such that when the rollers 14 and squeeze the walls of the transmission hose 24 and subsequently the liquid inside of the transmission hose 24 by way of the rotation of the rollers 14 on the gear disk 13 and the planetary rotation of the rollers 14 in the reservoir 22 of the cover 20. Alternatively, the gear disk 13 and the rollers 14 can be integrally formed to serve the same purposes.

In case the roller provided is single, it can push and squeeze the transmission hose for transmitting the liquid. Alternatively, the gear disk and the roller can be substituted by a cam, which is also within the scope of this invention.

The invention is novel and rich of commercial value as claimed by the inventor.

I claim:

1. A liquid rationing device comprising:

a base having a hole;

an actuating element mounted on said base and having an axle extending through said hole, said axle having an end provided with a gear;

a gear disk engaged with said gear and drivingly connected with a plurality of rollers; and a cover coupled to one side of said base and having a reservoir; and a transmission hose fitted in said reservoir and surrounding a circle of said rollers, said transmission hose having a positioning extrusion, said reservoir having a positioning groove to receive said protruding extrusion;

whereby liquid in said transmission hose will be pushed and squeezed between inner walls of said base and said rollers when said actuating element is switched on, thereby making displacement of the liquid in said transmission hole and achieving a purpose of rationing.

2. The liquid rationing device according to claim 1, wherein more than one fastening holes are provided at pre-determined positions on a circle of said base.

3. The liquid rationing device according to claim 1, wherein a center of said base is provided with a hollow portion, while a central bottom of said gear disk is provided with an extruding ring for positioning in the hollow portion at a center of said base.

4. The liquid rationing device according to claim 1, wherein a central hole is provided at a respective one of said rollers.

5. The liquid rationing device according to claim 1, wherein more than one positioning posts are provided at one side of said gear disk for positioning said rollers.

6. The liquid rationing device according to claim 4, wherein a positioning protrusion is protrusively provided on a side of said rollers, opposite to where said central hole of each of said rollers, and an inner surface of said cover is provided with a circle groove for locking with said positioning protrusion when combining to said base.

7. The liquid rationing device according to claim 1, wherein a pivot is provided at a center of said reservoir.

8. The liquid rationing device according to claim 1, wherein more than one locking flaps are provided at predetermined positions on a circle of said cover.

* * * * *